US012410030B2

(12) United States Patent
Noso et al.

(10) Patent No.: US 12,410,030 B2
(45) Date of Patent: Sep. 9, 2025

(54) SHEET POST-PROCESSING DEVICE AND IMAGE FORMING SYSTEM INCLUDING SAME

(71) Applicant: KYOCERA Document Solutions Inc., Osaka (JP)

(72) Inventors: Terumitsu Noso, Osaka (JP); Keisuke Egawa, Osaka (JP); Yasunori Ueno, Osaka (JP); Seiichi Shirasaki, Osaka (JP); Takehiko Okada, Osaka (JP); Yusuke Takano, Osaka (JP); Takuya Nishimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 16 days.

(21) Appl. No.: 18/403,072

(22) Filed: Jan. 3, 2024

(65) Prior Publication Data

US 2024/0228212 A1 Jul. 11, 2024

(30) Foreign Application Priority Data

Jan. 11, 2023 (JP) ..... 2023-002391
Mar. 30, 2023 (JP) ..... 2023-054507

(51) Int. Cl.
*B65H 31/36* (2006.01)
*B65H 37/04* (2006.01)

(52) U.S. Cl.
CPC ..... *B65H 31/36* (2013.01); *B65H 37/04* (2013.01); *B65H 2301/51611* (2013.01); *B65H 2404/1114* (2013.01)

(58) Field of Classification Search
CPC .. B65H 2301/51611; B65H 2404/1114; B65H 37/04; B65H 31/36
See application file for complete search history.

(56) References Cited

U.S. PATENT DOCUMENTS

| | | | | |
|---|---|---|---|---|
| 9,586,783 | B2 * | 3/2017 | Obuchi | B65H 31/02 |
| 2004/0183249 | A1 | 9/2004 | Sato | 271/220 |
| 2007/0029722 | A1 | 2/2007 | Sato | 271/207 |
| 2007/0029723 | A1 | 2/2007 | Sato | 271/207 |
| 2007/0029724 | A1 | 2/2007 | Sato | 271/220 |
| 2017/0137253 | A1 * | 5/2017 | Sato | B65H 31/36 |
| 2022/0380162 | A1 * | 12/2022 | Kosuge | B65H 31/02 |
| 2023/0183034 | A1 * | 6/2023 | Mitsui | B65H 31/36 |

FOREIGN PATENT DOCUMENTS

JP 2004-277158 A 10/2004

* cited by examiner

*Primary Examiner* — Jennifer Bahls
(74) *Attorney, Agent, or Firm* — Stein IP, LLC

(57) ABSTRACT

A sheet post-processing device includes a conveying member, a processing tray, a processing section, a reference plate, an alignment member, a holder drive unit, and a control unit. The alignment member includes a paddle holder supported in a swingable manner along a carry-in direction, and an alignment paddle supported in a rotatable manner at a swinging end of the paddle holder. The holder drive unit moves the alignment paddle in a reciprocating manner, between a reference position to retreat the paddle part above a top sheet placed on the processing tray and an acting position to allow the paddle part to contact with a top surface of the sheet. When the number of the sheets carried in onto the processing tray is increasing, the control unit continuously moves the acting position of the alignment paddle in a direction separating from the processing tray.

11 Claims, 9 Drawing Sheets

SHEET POST-PROCESSING DEVICE AND IMAGE FORMING SYSTEM INCLUDING SAME

INCORPORATION BY REFERENCE

This application is based upon and claims the benefit of priority from the corresponding Japanese Patent Applications No. 2023-002391 and 2023-054507 filed Jan. 11, 2023, and Mar. 30, 2023, respectively, the entire contents of which are hereby incorporated by reference.

BACKGROUND

The present disclosure relates to a sheet post-processing device that performs predetermined post-processing on a sheet after image formation by an image forming apparatus, and to an image forming system including the same.

There is known a sheet post-processing device, which stacks a plurality of sheets after image formation by the image forming apparatus such as a copier or a printer, and performs a stapling process in which the stacked sheets are stapled as a whole by a stapler, a hole punching process in which punch holes (perforation holes) are formed in the sheets by a hole punching device, or a folding process in which a fold line is formed in the sheets.

This sheet post-processing device is equipped with a processing tray on which a predetermined number of sheets after image formation are placed. Then, the stapling process, a shift discharge process (sorting process), or the like is performed on the sheets placed on the processing tray. In addition, in order to smoothly perform the stapling process, the shift discharge process, or the like, the sheets on the processing tray are aligned using an alignment member such as an alignment paddle.

SUMMARY

A sheet post-processing device according to one aspect of the present disclosure includes a conveying member, a processing tray, a processing section, a reference plate, an alignment member, a holder drive unit, and a control unit. The conveying member conveys a sheet. The processing tray stacks a plurality of sheets conveyed in a predetermined carry-in direction by the conveying member. The processing section performs predetermined post-processing on the sheets placed on the processing tray. The reference plate abuts an edge of the sheet carried in onto the processing tray on a downstream side in an alignment direction opposite to the carry-in direction, so as to align the sheet in the carry-in direction. The alignment member includes a paddle holder disposed above the processing tray so as to be supported in a swingable manner in the carry-in direction, and an alignment paddle having a paddle main body supported in a rotatable manner at a swinging end of the paddle holder and a paddle part protruding from the paddle main body in a radial direction, so as to move the sheet carried in onto the processing tray in the alignment direction for aiding alignment of the sheets. The holder drive unit swings the paddle holder, so as to move the alignment paddle in a reciprocating manner between a reference position to retreat the paddle part above a top sheet placed on the processing tray and an acting position to allow the paddle part to contact with the top surface of the sheet. The control unit controls the holder drive unit. When the number of the sheets carried in onto the processing tray is increasing, the control unit continuously moves the acting position of the alignment paddle in a direction separating from the processing tray.

DETAILED DESCRIPTION

1. Structure of Image Forming System

Figure 1:
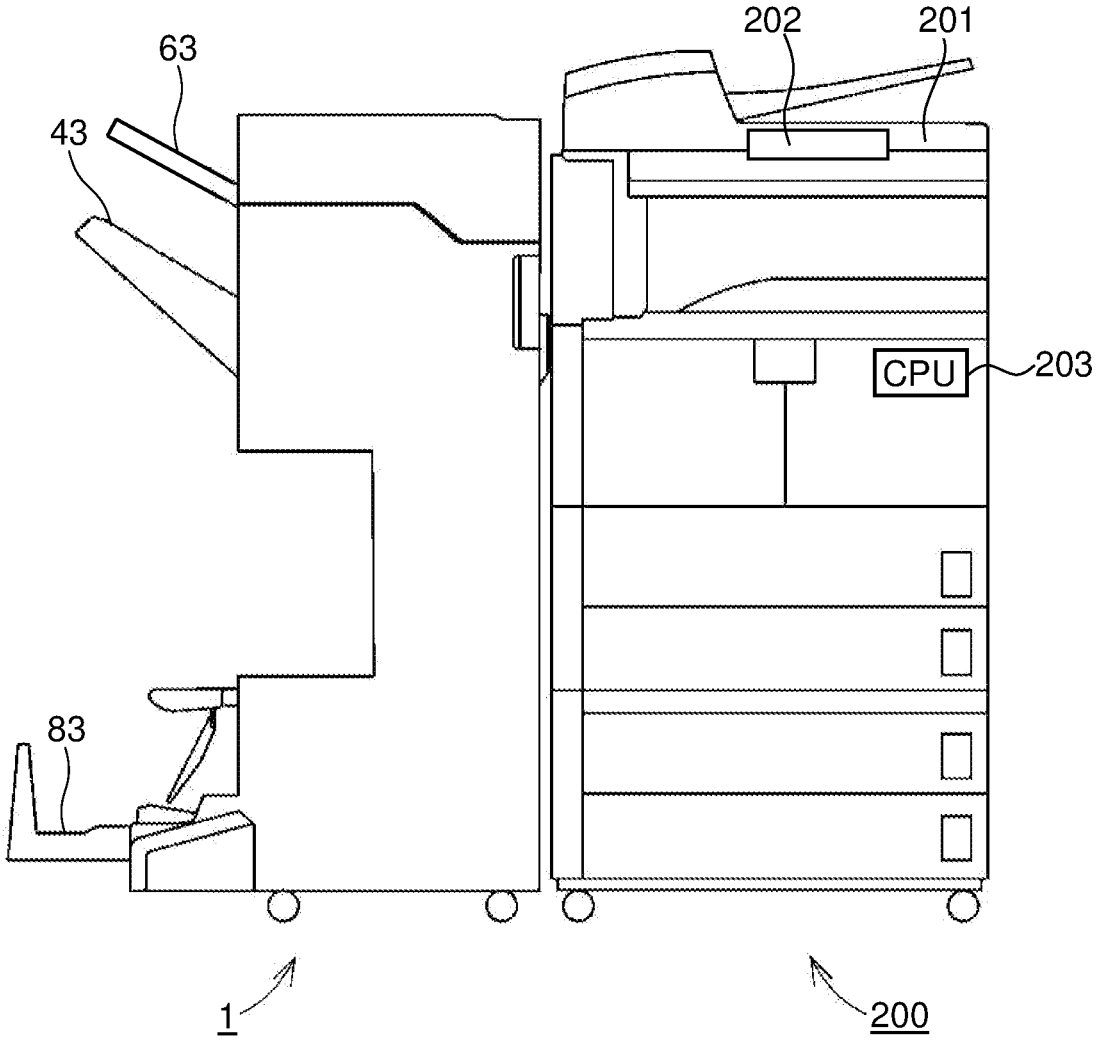
FIG. 1 is a schematic diagram illustrating a structure of an image forming system constituted of a sheet post-processing device according to a first embodiment of the present disclosure, and an image forming apparatus to which the sheet post-processing device is connected.

Hereinafter, with reference to the drawings, an embodiment of the present disclosure is described in detail. FIG. 1 is a schematic diagram illustrating a structure of an image forming system constituted of a sheet post-processing device 1 including a sheet stapling unit 92 according to a first embodiment of the present disclosure, and an image forming apparatus 200 to which the sheet post-processing device 1 is connected.

As illustrated in FIG. 1, the image forming apparatus 200 prints an image on a sheet (paper sheet), on the basis of image data input externally via a not-shown network communication unit, or image data read by an image reading unit 201 disposed at an upper part of the image forming apparatus 200. In this embodiment, the image forming apparatus 200 is an inkjet recording device including recording heads (not shown) of respective colors, each of which has many nozzle holes for ejecting ink to a sheet.

An operation panel 202 is disposed on a front of the image reading unit 201. The operation panel 202 is an operation unit for receiving various setting inputs. For instance, a user can operate the operation panel 202 to input size information of the sheet. In addition, it is possible to operate the operation panel 202 to input the number of the sheet to be printed or to instruct start of a print job. A main body control unit 203 controls the whole operation of the image forming apparatus 200, and controls individual units of the image forming apparatus 200.

The sheet post-processing device 1 is connected to a side face of the image forming apparatus 200 in an attachable and detachable manner. The sheet post-processing device 1 performs post-processing such as a hole punching process, a stapling process, or the like, on sheets after image formation (printing) by the image forming apparatus 200. Note that the sheet post-processing device 1 is not limited to one that performs the post-processing on the sheets conveyed automatically from the image forming apparatus 200, but may be one that conveys sheets set on a not-shown tray by a user to a position at which the post-processing can be performed, and performs the post-processing on the sheets.

2. Structure of Sheet Post-Processing Device

Figure 2:
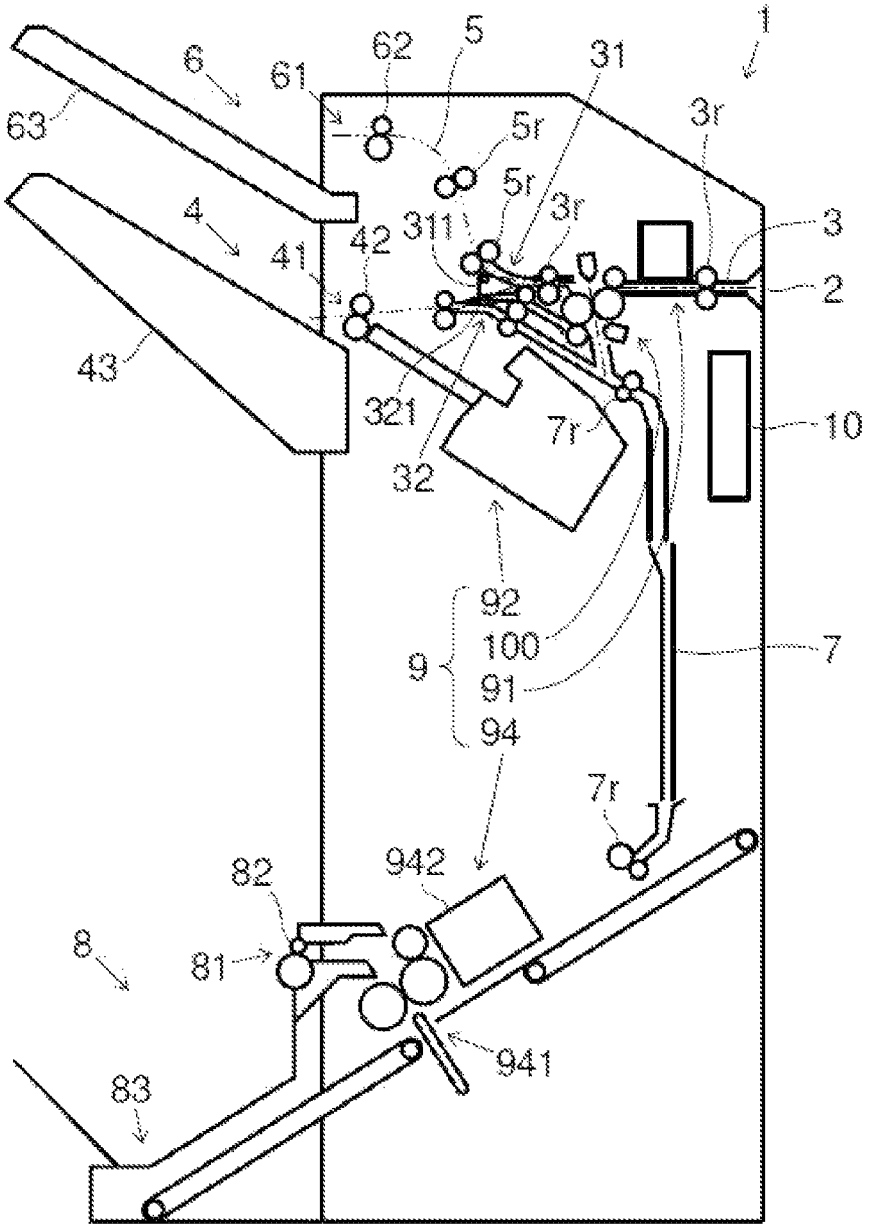
FIG. 2 is a cross-sectional side view schematically illustrating a structure of the sheet post-processing device of the first embodiment.

FIG. 2 is a cross-sectional side view schematically illustrating a structure of the sheet post-processing device 1 of the first embodiment. As illustrated in FIG. 2, the sheet post-processing device 1 includes a sheet carry-in entrance 2, a first sheet conveying path 3, a first sheet discharge unit 4, a second sheet conveying path 5, a second sheet discharge unit 6, a third sheet conveying path 7, a third sheet discharge unit 8, a post-processing unit 9, and a post-processing control unit (control unit) 10.

The sheet carry-in entrance 2 is an opening formed on the side face of the sheet post-processing device 1, which faces the image forming apparatus 200. The sheet conveyed from the image forming apparatus 200 to the sheet post-processing device 1 passes through the sheet carry-in entrance 2 and is carried into the sheet post-processing device 1.

The first sheet conveying path 3 extends in a substantially horizontal direction from the sheet carry-in entrance 2 to the first sheet discharge unit 4, in a direction separating from the image forming apparatus 200 (to the left direction in FIG. 2). Note that the direction from the sheet carry-in entrance 2 to the first sheet discharge unit 4 is referred to as a sheet conveying direction of the first sheet conveying path 3. The sheet carry-in entrance 2 is positioned at an upstream end of the first sheet conveying path 3 in the sheet conveying direction. The first sheet conveying path 3 includes a plurality of convey roller pairs 3*r*, and conveys the sheet carried in from the sheet carry-in entrance 2 to the sheet post-processing device 1, toward the downstream side in the sheet conveying direction.

The first sheet discharge unit 4 is disposed at a side face of the sheet post-processing device 1, which is opposite to the side face facing the image forming apparatus 200. The first sheet discharge unit 4 is disposed at a downstream end of the first sheet conveying path 3 in the sheet conveying direction. The first sheet discharge unit 4 includes a first discharge outlet 41, a first discharge roller pair 42, and a first discharge tray 43.

The first discharge outlet 41 is positioned at the downstream end of the first sheet conveying path 3 in the sheet conveying direction. The first discharge roller pair 42 is disposed at the first discharge outlet 41. The first discharge tray 43 is positioned on the downstream side of the first discharge outlet 41 in the sheet conveying direction. The sheet, which is conveyed along the first sheet conveying path 3 and reaches the first discharge outlet 41, is discharged onto the first discharge tray 43 by the first discharge roller pair 42 after passing through the first discharge outlet 41. The first discharge tray 43 is one of final discharge places of the sheets after post-processing by the sheet post-processing device 1.

The second sheet conveying path 5 branches from the first sheet conveying path 3 at a first junction (junction) 31 and extends laterally and upwardly to the second sheet discharge unit 6, in the direction separating from the image forming apparatus 200 (to the left direction in FIG. 2). The first junction 31 is disposed on the downstream side of a perforation unit 91 in the sheet conveying direction of the first sheet conveying path 3. Note that the direction from the first junction 31 to the second sheet discharge unit 6 is referred to as a sheet conveying direction of the second sheet conveying path 5. The first junction 31 is positioned at the upstream end of the second sheet conveying path 5 in the sheet conveying direction. The second sheet conveying path 5 includes a plurality of convey roller pairs 5*r*, and allows the sheet conveyed along the first sheet conveying path 3 to branch at the first junction 31, and conveys the same to the second sheet discharge unit 6.

The first junction 31 includes a first switching guide 311. The first switching guide 311 rotates between a position for guiding the sheet, which is conveyed from the sheet carry-in entrance 2 along the first sheet conveying path 3, to the first discharge outlet 41 along the first sheet conveying path 3, and a position for guiding the sheet to the second sheet conveying path 5 after branching from the first sheet conveying path 3. Furthermore, the first switching guide 311 rotates to a position for guiding the sheet, which passes through a later-described second folding conveying path 106 after a folding process, to the second sheet conveying path 5. The first switching guide 311 is connected to a drive mechanism (not shown), and its operation is controlled by the post-processing control unit 10.

The second sheet discharge unit 6 is disposed above the first sheet discharge unit 4 on the side face of the sheet post-processing device 1, which is opposite to the side face facing the image forming apparatus 200. The second sheet discharge unit 6 is disposed at the downstream end of the second sheet conveying path 5 in the sheet conveying direction. The second sheet discharge unit 6 includes a second discharge outlet 61, a second discharge roller pair 62, and a second discharge tray 63.

The second discharge outlet 61 is positioned at the downstream end of the second sheet conveying path 5 in the sheet conveying direction. The second discharge roller pair 62 is disposed at the second discharge outlet 61. The second discharge tray 63 is positioned on the downstream side of the second discharge outlet 61 in the sheet conveying direction. The sheet, which is conveyed along the second sheet conveying path 5 and reaches the second discharge outlet 61, is discharged onto the second discharge tray 63 by the second discharge roller pair 62 after passing through the second discharge outlet 61. The second discharge tray 63 is one of the final discharge places of the sheets after post-processing by the sheet post-processing device 1. In addition, sheets on which the post-processing is not performed, small size sheets, or the like are also discharged onto the second discharge tray 63.

The third sheet conveying path 7 branches from the first sheet conveying path 3 at a second junction 32, and extends downward to the third sheet discharge unit 8. Note that the direction from the second junction 32 to the third sheet discharge unit 8 is referred to as a sheet conveying direction of the third sheet conveying path 7. The second junction 32 is positioned on the downstream side of the first junction 31 in the sheet conveying direction of the first sheet conveying path 3, and is positioned at the upstream end of the third sheet conveying path 7 in the sheet conveying direction. The third sheet conveying path 7 includes a plurality of convey roller pairs 7*r*, allows the sheet conveyed along the first sheet conveying path 3 to branch at the second junction 32, and conveys the same to the third sheet discharge unit 8.

The second junction 32 includes a second switching guide 321. The second switching guide 321 rotates between a position for guiding the sheet, which is conveyed from the sheet carry-in entrance 2 along the first sheet conveying path 3, to the first discharge outlet 41 along the first sheet conveying path 3, and a position for guiding the sheet, which is conveyed from the sheet carry-in entrance 2 along the first sheet conveying path 3 and is switched back after passing through the second junction 32, to the third sheet conveying path 7. The second switching guide 321 is connected to a drive mechanism (not shown), and its operation is controlled by the post-processing control unit 10.

The third sheet discharge unit 8 is disposed below the first sheet discharge unit 4 (near a lower end part of the sheet post-processing device 1), on the side face of the sheet post-processing device 1, which is opposite to the side face facing the image forming apparatus 200. The third sheet discharge unit 8 includes a third discharge outlet 81, a third discharge roller pair 82, and a third discharge tray 83.

The third discharge outlet 81 is positioned at the downstream end of the third sheet conveying path 7 in the sheet conveying direction. The third discharge roller pair 82 is disposed at the third discharge outlet 81. The third discharge tray 83 is positioned on the downstream side of the third discharge outlet 81 in the sheet conveying direction. The sheet, which is conveyed along the third sheet conveying path 7 and reaches the third discharge outlet 81, is discharged onto the third discharge tray 83 by the third discharge roller pair 82 after passing through the third discharge outlet 81. The third discharge tray 83 is one of the final discharge places of the sheets after post-processing by the sheet post-processing device 1.

The post-processing unit 9 performs predetermined post-processing on the sheets carried into the sheet post-processing device 1 after image formation by the image forming apparatus 200. The post-processing unit 9 includes the perforation unit 91, the sheet stapling unit 92, a sheet folding unit 100, and a binding unit 94.

The perforation unit 91 is disposed near the downstream side of the sheet carry-in entrance 2 of the first sheet conveying path 3. The perforation unit 91 performs a perforation process on the sheet conveyed along the first sheet conveying path 3, so as to form punch holes.

The sheet stapling unit 92 is disposed near the upstream side of the first sheet discharge unit 4 in the sheet conveying direction of the first sheet conveying path 3. The sheet stapling unit 92 performs the stapling process on a bundle of sheets formed by stacking a plurality of sheets, so as to staple the sheets. A detailed structure of the sheet stapling unit 92 will be described later.

The sheet folding unit 100 is disposed on the downstream side of the perforation unit 91 and the upstream side of the stapling unit 92, in the sheet conveying direction of the first sheet conveying path 3. The sheet folding unit 100 performs the folding process on one sheet so as to form a fold line. The sheet folding unit 100 can perform the folding process on one sheet, such as half-fold, Z-hold, outer three-fold, inner three-fold, or the like.

The binding unit 94 is disposed near the upstream side of the third sheet discharge unit 8 in the sheet conveying direction of the third sheet conveying path 7. The binding unit 94 includes a center-folding unit 941 and a center-stapling unit 942. The binding unit 94 performs a center-folding process and a center-stapling process for folding and stapling the substantial center of a bundle of sheets formed by stacking a plurality of sheets, in the sheet conveying direction, so as to make a booklet.

The post-processing control unit (control unit) 10 includes a CPU, a storage unit, and other electronic circuits and components (which are not shown). The post-processing control unit 10 is connected to the main body control unit 203 (see FIG. 1) of the image forming apparatus 200 in a communicable manner. The post-processing control unit 10 receives a command from the main body control unit 203, controls operations of individual components of the sheet post-processing device 1, and performs processing related to functions of the sheet post-processing device 1, using the CPU on the basis of control programs and data stored in the storage unit. The first sheet conveying path 3, the first sheet discharge unit 4, the second sheet conveying path 5, the second sheet discharge unit 6, the third sheet conveying path 7, the third sheet discharge unit 8, and the post-processing unit 9 each receive commands from the post-processing control unit 10 individually, and cooperate to perform post-processing on the sheet. Note that it may be possible that functions of the post-processing control unit 10 are performed by the main body control unit 203 of the image forming apparatus 200.

3. Structure of Sheet Stapling Unit

Figure 3:
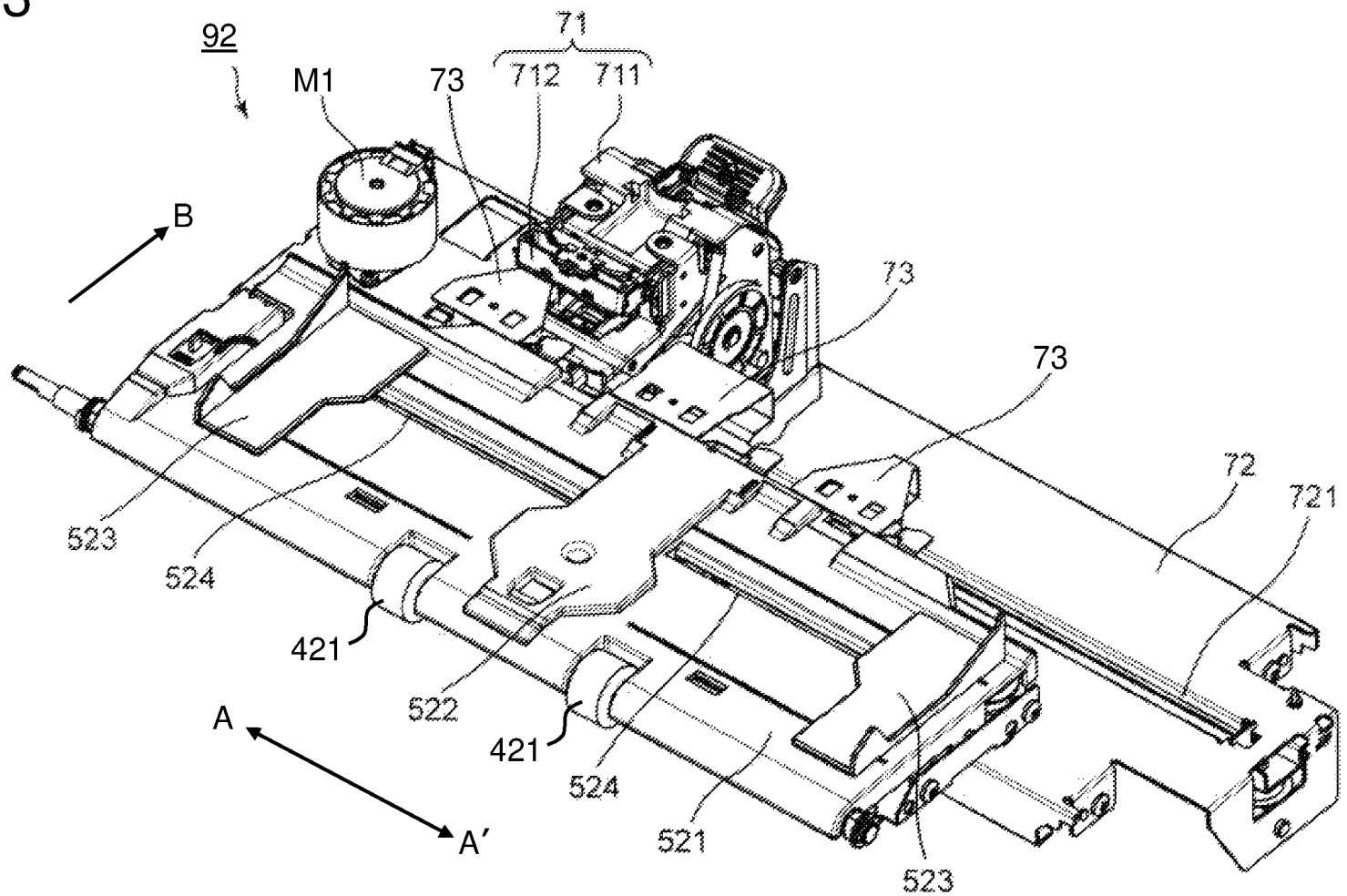
FIG. 3 is a perspective view of a sheet stapling unit mounted on the sheet post-processing device of the first embodiment.
Figure 4:
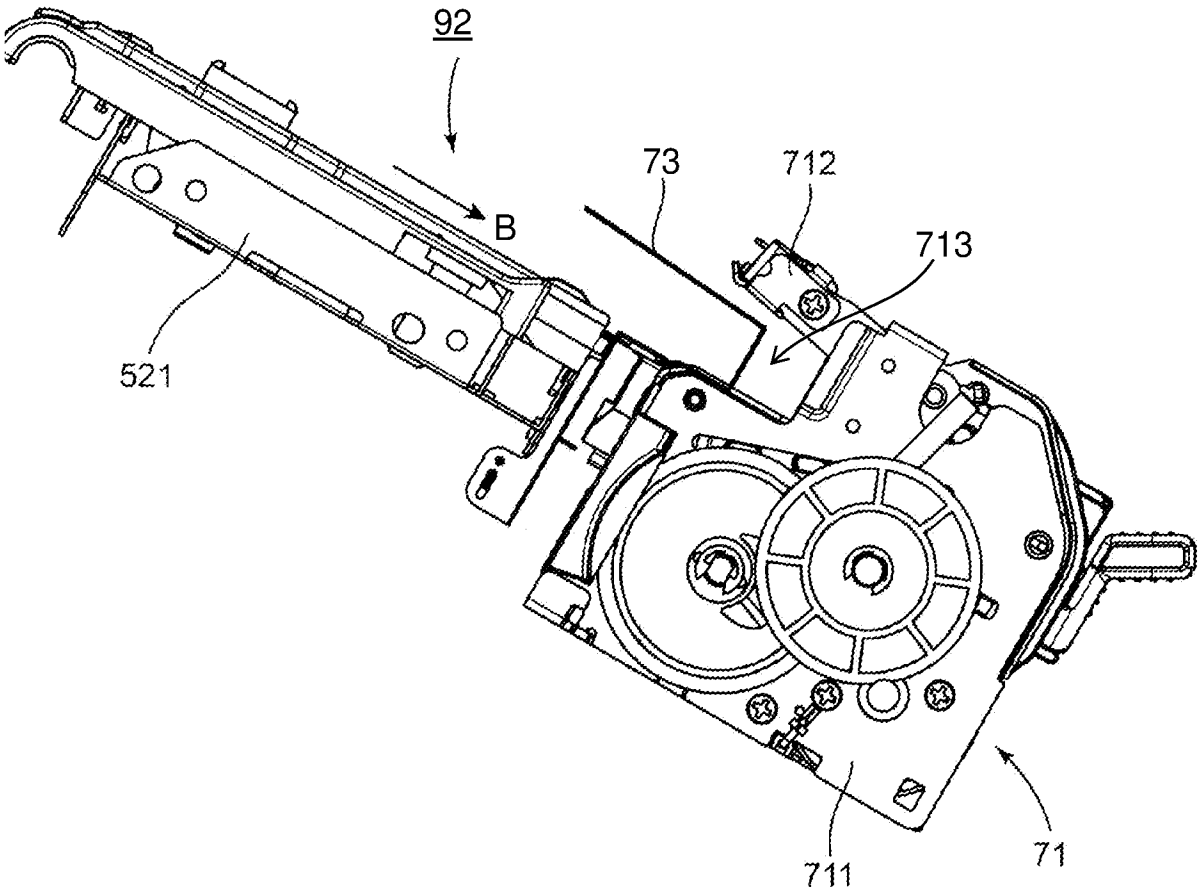
FIG. 4 is a side view of the sheet stapling unit.

Next, a structure of the sheet stapling unit 92 is described. FIG. 3 is a perspective view of the sheet stapling unit 92 mounted on the sheet post-processing device 1. FIG. 4 is a side view of the sheet stapling unit 92.

As illustrated in FIG. 3, the sheet stapling unit 92 includes a processing tray 521, a stapling unit 71, and a reference plate 73.

The processing tray 521 is a rectangular tray that extends in a sheet width direction (arrow AA' direction) and in a carry-in direction. A plurality of sheets S (the bundle of sheets) to be stapled are placed on the processing tray 521. In this case, the sheets S are carried in onto the processing tray 521 in the alignment direction toward the lower right direction in FIG. 4 (arrow B direction), which is the opposite direction to the carry-in direction. The bundle of sheets after the stapling process is eventually sent out by the first discharge roller pair 42 (see FIG. 2) in the opposite direction to the above alignment direction (to the upper left direction in FIG. 4), and is discharged onto the first discharge tray 43 (see FIG. 2). The downstream side of the processing tray 521 in the carry-in direction (the lower left side in FIG. 3) supports a lower discharge roller 421 constituting the first discharge roller pair 42.

The processing tray 521 includes a tray middle part 522 and width restricting members 523. The tray middle part 522 is disposed on the top surface part of the processing tray 521 in the middle part in the sheet width direction. The tray middle part 522 is a sheet-like member fixed on the processing tray 521 with a slight height.

The width restricting members 523 are disposed in pair on both sides of the tray middle part 522 in the sheet width direction. The width restricting members 523 restrict a position in the sheet width direction of the sheet S carried in onto the processing tray 521. The width restricting member 523 is constituted of a sheet-like member similarly to the tray middle part 522, and has a sidewall standing upward at an end in the sheet width direction. The processing tray 521 is provided with a guide groove 524 formed to extend in the sheet width direction. The width restricting members 523 can be moved in a reciprocating manner along the guide groove 524 in the sheet width direction, by a drive mechanism such as a rack and pinion gear (not shown). In this embodiment, every time when the sheet is carried in onto the processing tray 521, the width restricting members 523 are driven by the drive mechanism to move in a reciprocating manner. As a result, the sheet placed on the processing tray 521 is aligned in the sheet width direction.

The stapling unit 71 is disposed so as to face an end edge of the sheet on the front end side in the alignment direction (the right side in FIG. 4). The stapling unit 71 can be moved by drive force of a stapling unit drive motor M1 along the end edge of the sheet in the sheet width direction (arrow AA' direction) perpendicular to the carry-in direction, and performs the stapling process on the bundle of the sheets.

As illustrated in FIG. 4, the stapling unit 71 includes a staple main body part 711 and a staple movable part 712. The staple main body part 711 is a main body part of the stapling unit 71, in which a plurality of staple needles (not shown) are housed. The staple movable part 712 can move in the up and down direction, so as to insert the staple needle into the sheets. Between the staple main body part 711 and the staple movable part 712, there is formed a recess 713 into which the end edge of the sheet enters.

The reference plates 73 are fixed at three positions separated in the sheet width direction, so as to face the end of the processing tray 521 on the downstream side (the upper right side in FIG. 3 and the lower right side in FIG. 4) in the alignment direction. The reference plate 73 has a substantial U-shape that opens to the upstream side (the upper left side in FIG. 4) in the alignment direction, in a cross section perpendicular to the sheet width direction. The reference plate 73 abuts the end edge of the sheet carried in onto the processing tray 521, so as to align the sheet in the carry-in direction.

4. Structure of Processing Tray and its Vicinity of Sheet Stapling Unit

Figure 5:
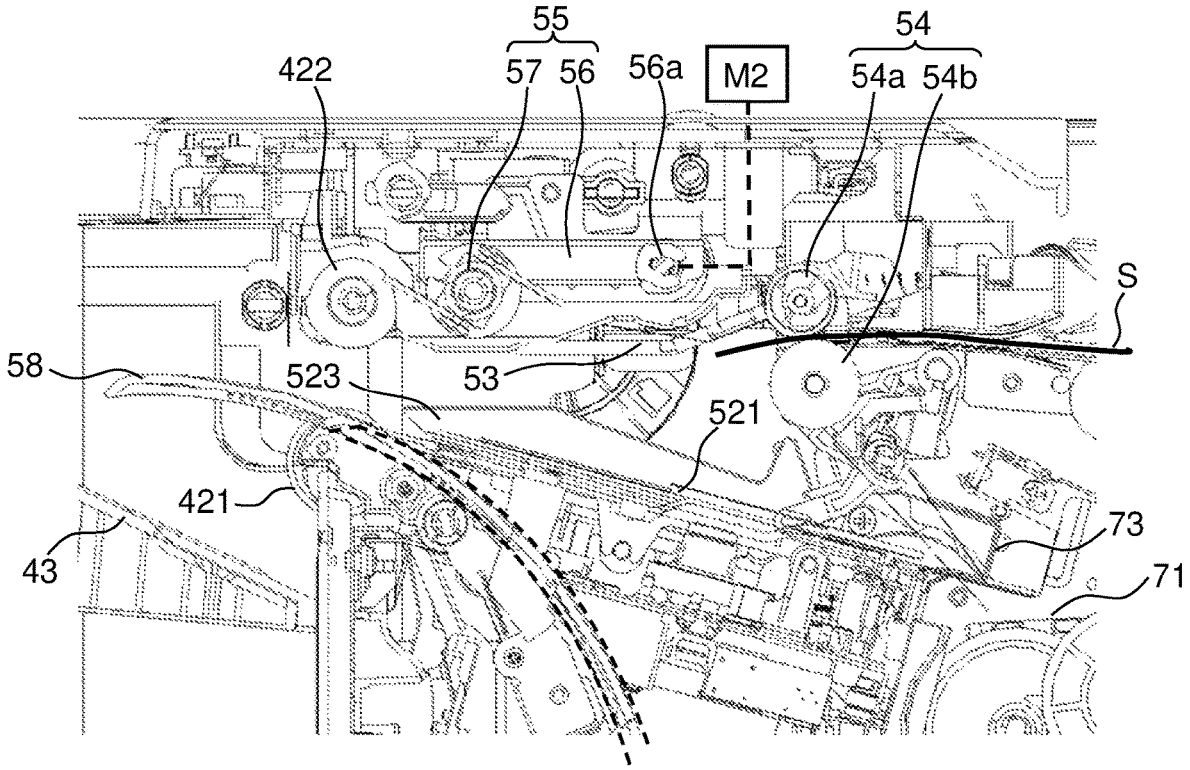
FIG. 5 is a cross-sectional side view illustrating a processing tray, an alignment member, and their vicinity, in a state where an alignment paddle is positioned at a retreat position.

FIG. 5 is a cross-sectional side view illustrating a structure of the processing tray 521, an alignment member 55, and their vicinity. As illustrated in FIG. 5, a carry-in roller pair 54 is disposed above the processing tray 521. The carry-in roller pair 54 is constituted of an upper carry-in roller 54*a* and a lower carry-in roller 54*b*.

A sheet detection sensor 93 is disposed in a vicinity of the carry-in roller pair 54. The sheet detection sensor 93 detects timing when the sheet S passes the carry-in roller pair 54. As the sheet detection sensor 93, for example, a photo interrupter (PI) sensor is used, which includes a detection unit constituted of a light emitting part and a light receiving part.

A tapping member 53 and the alignment member 55 are disposed on the downstream side of the carry-in roller pair 54 in the carry-in direction of the sheet S (the left side in FIG. 5). The tapping member 53 is supported in a swingable manner along the carry-in direction of the sheet S. The tapping member 53 swings downward at timing when the rear end of the sheet S passes the carry-in roller pair 54, so as to tap the sheet S downward to be along the processing tray 521.

The alignment members 55 are disposed at a plurality of places (four places in this embodiment) in the sheet width direction (the direction perpendicular to the paper of FIG. 5). The alignment member 55 moves (switchbacks) the sheet S carried in onto the processing tray 521 in the alignment direction to approach the reference plate 73, so as to aid alignment of the sheet S. The alignment member 55 includes a paddle holder 56 and an alignment paddle 57.

The paddle holder 56 is supported in a swingable manner along the carry-in direction of the sheet S above the processing tray 521. A rotation drive force from a holder drive motor M2 is input to a swing shaft 56*a* of the paddle holder 56. As the holder drive motor M2, a stepping motor is used, which can be accurately controlled in its rotation direction and rotation amount (rotation angle) by pulse control. In addition, there is disposed an HP detection sensor (not shown) for detecting a reference position (home position) of the paddle holder 56 (the alignment paddle 57). The post-processing control unit 10 estimates height of the alignment paddle 57 (distance from the processing tray 521), on the basis of a detection signal of the HP detection sensor and the number of the sheets S placed on the processing tray 521.

Figure 6:
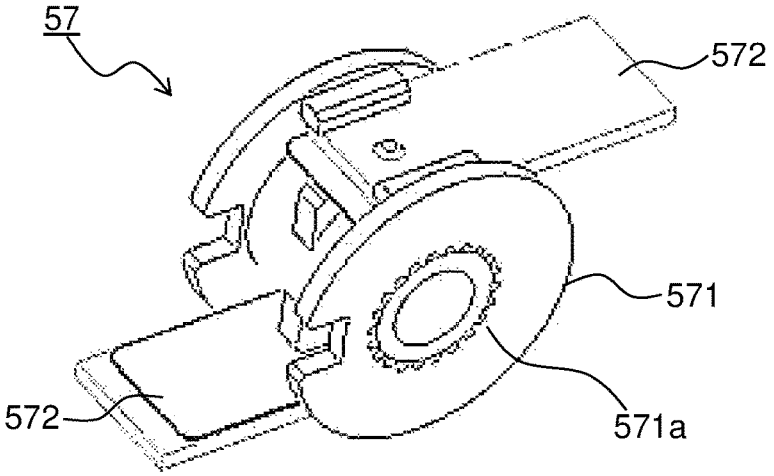
FIG. 6 is a perspective view of the alignment paddle.

FIG. 6 is a perspective view of the alignment paddle 57. The alignment paddle 57 includes a paddle main body 571 and paddle parts 572. The paddle main body 571 has a cylindrical shape, in which a fulcrum part 571*a* is formed. The fulcrum part 571*a* is a through hole penetrating along the center axis of the paddle main body 571, and is supported in a rotatable manner at the swinging end of the paddle holder 56 (the left end in FIG. 5). The paddle parts 572 are rubber sheets, which protrude in tangent directions (to the upstream side in the rotation direction) from symmetric positions on an outer periphery of the paddle main body 571, with respect to the center of the fulcrum part 571*a*.

A rotation drive force is input to the alignment paddle 57 from a drive source such as a motor (not shown), in a direction to send out the sheet S in the alignment direction (the counterclockwise direction in FIG. 5). When the paddle part 572 of the alignment paddle 57 rotates in contact with the top surface of the sheet S carried in onto the processing tray 521, the sheet S is moved in the alignment direction, and the end edge of the sheet abuts the reference plate 73 for alignment. The alignment paddle 57 rotates by a preset number of rotations (for example, by two rotations), and then stops.

The swinging of the paddle holder 56 is controlled based on the detection timing of the sheet detection sensor 93. Specifically, at timing when the sheet detection sensor 93 detects that the front end of the sheet S passes the carry-in roller pair 54, the paddle holder 56 is swung in the upward direction. As a result, the paddle part 572 separates from the top surface of the processing tray 521 (or the sheet S placed on the processing tray 521).

A support member 58 is disposed below the processing tray 521. The support member 58 is a rod-like member that has a predetermined width in the sheet width direction and extends in an arc shape in the discharge direction, and is disposed below the first discharge outlet 41. More specifically, the support member 58 is disposed below the processing tray 521, and below a discharge path of the sheet S that is discharged from the first discharge roller pair 42 along the processing tray 521. In this embodiment, the support members 58 are disposed at two positions in the sheet width direction separated by predetermined distances from the middle part of the processing tray 521 in the sheet width direction.

The support member 58 can move between a protruding position to protrude from the first discharge roller pair 42 to the downstream side in the discharge direction (the left side in FIG. 5), which is the position illustrated by a solid line in FIG. 5, and a retreat position to retreat from the first discharge roller pair 42 to the upstream side in the discharge direction (the right side in FIG. 5), which is the position illustrated by a broken line in FIG. 5. When the sheet S is carried in onto the processing tray 521 (when it is switched back), the support member 58 is positioned at the protruding position, so as to support a part of the sheet S protruding on the first discharge tray 43.

FIG. 5 illustrates a state just before a new sheet S is carried in onto the processing tray 521, in which the paddle holder 56 is swung in the upward direction (clockwise direction), and the alignment paddle 57 is positioned at a position apart from the processing tray 521 (the reference position). In addition, a nip between the lower discharge roller 421 and an upper discharge roller 422 constituting the first discharge roller pair 42 is released. In this way, the sheet S carried in onto the processing tray 521 by the carry-in roller pair 54 temporarily passes the first discharge roller pair 42 and protrudes on the first discharge tray 43.

Figure 7:
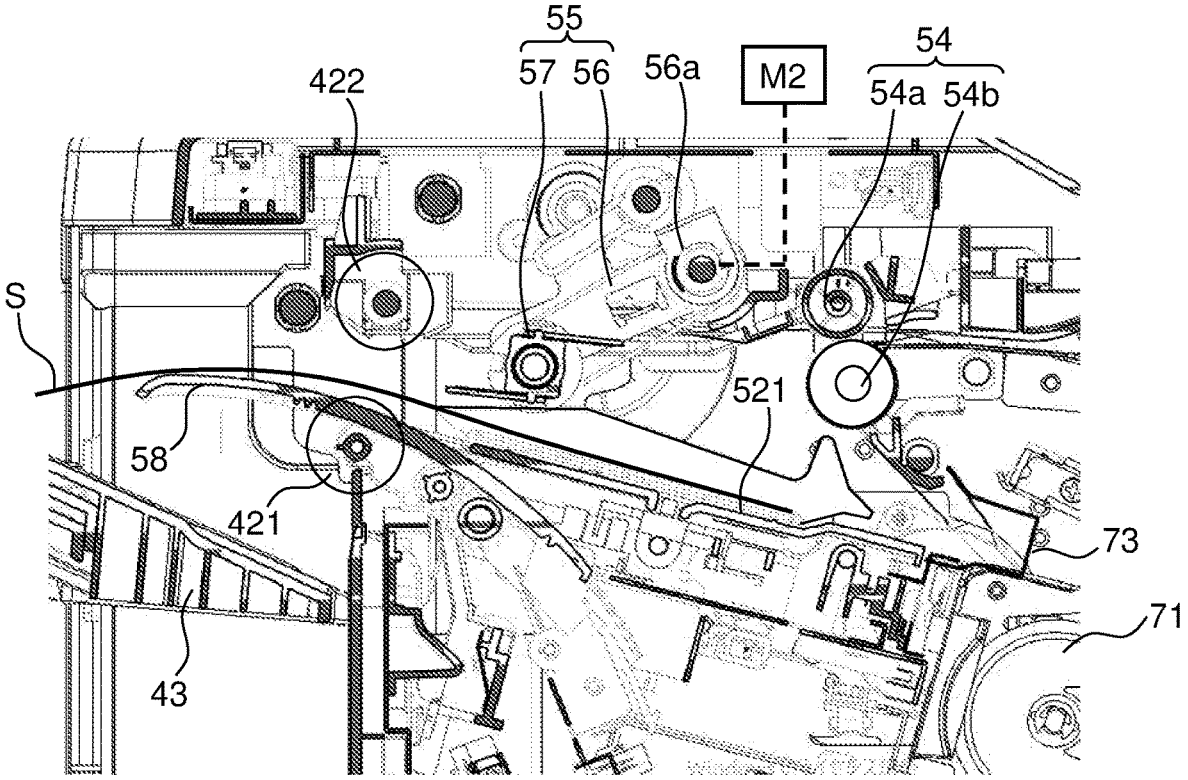
FIG. 7 is a cross-sectional side view illustrating the processing tray, the alignment member, and their vicinity, in a state where the alignment paddle is positioned at an acting position.

Further, at timing when the rear end of the new sheet S carried in onto the processing tray 521 passes the carry-in roller pair 54, the paddle holder 56 is swung in the reverse direction (the counterclockwise direction) as illustrated in FIG. 7. As a result, the alignment paddle 57 is positioned at a position where the paddle part 572 makes contact with the top surface of the sheet S (the acting position). The operation described above is repeatedly performed every time when the sheet S is carried in, and hence the paddle part 572 can securely make contact with the top surface of the sheet S while avoiding interference between the paddle part 572 and the front end of the sheet S carried in onto the processing tray 521.

5. Adjustment Control of Acting Position of Alignment Paddle

Next, adjustment control of the acting position of the alignment paddle 57 is described. In this embodiment, the acting position of the alignment paddle 57 is changed based on the number of the sheets S carried in onto the processing tray 521. More specifically, when the number of the sheets S carried in onto the processing tray 521 is increasing, the acting position of the alignment paddle 57 is being separated from the processing tray 521.

Specifically, the post-processing control unit 10 counts the number of the sheets S carried in onto the processing tray 521. Then, it sends a control signal to the holder drive motor M2, so as to move upward a stop position of the paddle holder 56 every time when one sheet S (or a predetermined number of sheets) is carried in. In this way, the acting position of the alignment paddle 57 is also moves upward continuously.

According to the structure described above, in accordance with the upward movement of the position of the top surface of the sheet S due to increase in the number of the sheets S carried in onto the processing tray 521, the acting position of the alignment paddle 57 also moves upward. As a result, regardless of the number of the sheets S that is carried in, the contact state of the paddle part 572 with the top surface of the sheet S can be maintained to be constant. Therefore, from a state where a small number of the sheets S are placed on the processing tray 521 to a state where the maximum possible number of the sheets S are placed on the same, the sheet S can be securely moved in the alignment direction, and the end edge of the sheet can abut the reference plate 73 for alignment.

Here, the conveying power of the alignment paddle 57 necessary for alignment of the sheet S varies largely depending on a type of the sheet S (size, thickness, basis weight, grain direction, or surface smoothness). If the sheet S is a paper sheet, fibers of the sheet S tend to align along the direction in which the sheet flows in a paper machine. This direction in which fibers align is referred to as the "grain direction" of the sheet S.

In addition, if the image forming apparatus 200 connected to the sheet post-processing device 1 is an inkjet recording device, a conveying load for pulling the sheet S onto the processing tray 521 varies depending also on the amount of ink used for image formation. Therefore, it may be difficult to securely convey the sheet S and to align the same only by setting the acting position based on the number of the carried-in sheets S.

Therefore, in this embodiment, the acting position of the alignment paddle 57 is adjusted based on output information about characteristics of the sheet S. Specifically, the output information about characteristics of the sheet S (a type of the sheet S and the amount of ink) is input from the image forming apparatus 200. The post-processing control unit 10 adjusts the acting position of the alignment paddle 57, on the basis of the output information about characteristics of the sheet S that is input.

Figure 8:
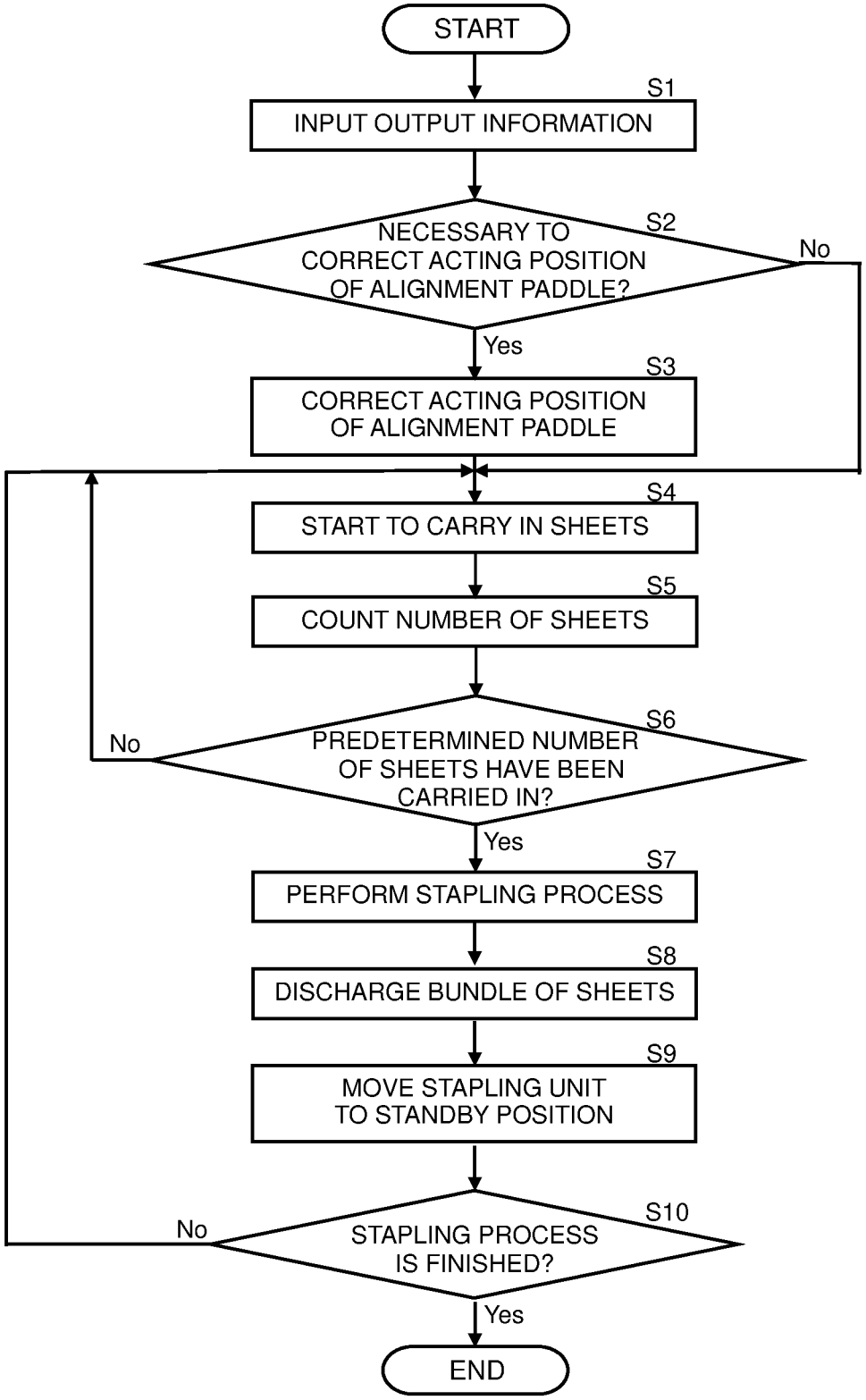
FIG. 8 is a flowchart illustrating an example of an adjustment control of an acting position of the alignment paddle in the sheet post-processing device of the first embodiment.

FIG. 8 is a flowchart illustrating an example of an adjustment control of the acting position of the alignment paddle 57, which is performed by the sheet stapling unit 92 of the first embodiment. With reference to FIGS. 1 to 7 as necessary, along the steps illustrated in FIG. 8, adjusting procedure of the acting position of the alignment paddle 57 is described. Note that it is supposed that, in an initial state, the acting position of the alignment paddle 57 is set at a reference acting position according to reference output information (for example, the output information that is used most frequently). In addition, in the following description, the output information about characteristics of the sheet S is also referred to simply as output information of the sheet.

When a stapling process command for the sheets S is input from the main body control unit 203 of the image forming apparatus 200, the output information of the sheet S is input together with the stapling process command (Step S1). Among the output information of the sheet S, information about a type of the sheet S such as size, thickness, basis weight, grain direction, or surface smoothness of the sheet S is input from the operation panel 202 of the image forming apparatus 200. For instance, it may be possible to store a manufacturer, a trade name, a product number, or the like of the sheet S in association with the corresponding information about a type of the sheet S in the main body control unit 203 in advance. In this way, only when the user selects a manufacturer, a trade name, a product number, or the like of the sheet S using the operation panel 202, the main body control unit 203 can recognize the information about a type of the sheet S to be used.

As for the information about the amount of ink, the main body control unit 203 calculates the amount of ink to be used for image formation, on the basis of image data sent from a host device such as a personal computer or the image reading unit 201, and sends out the same.

The post-processing control unit 10 determines whether or not it is necessary to correct the acting position of the alignment paddle 57, on the basis of the output information of the sheet S that is input (Step S2). If it is determined that it is necessary to correct the acting position (Yes in Step S2), the post-processing control unit 10 corrects the acting position of the alignment paddle 57 from the reference acting position (Step S3).

For instance, if a size, a thickness, a basis weight, or a surface friction force of the sheet S increases, the conveying power necessary for moving the sheet S is increased. Specifically, if the sheet S is a paper sheet made in Europe, it has a tendency to have less surface smoothness and a larger friction force between sheets than a paper sheet made in Japan or USA. In addition, if the grain direction of the sheet S is parallel to the sheet width direction, the conveying power necessary for moving the sheet S is larger than in the case where the grain direction of the sheet S is parallel to the carry-in direction. Therefore, if a size, a thickness, a basis weight, or a surface friction force of the sheet S is larger than the reference output information, or if the grain direction of the sheet S is parallel to the sheet width direction, the acting position of the alignment paddle 57 is corrected to be closer to the processing tray 521 than the reference acting position.

On the contrary, if a size, a thickness, a basis weight, or a surface friction force of the sheet S is smaller than the reference output information, or if the grain direction of the sheet S is parallel to the carry-in direction, the acting position of the alignment paddle 57 is corrected to be more distant from the processing tray 521 than the reference acting position. The correction amount from the reference acting position is determined based on a correction table, which defines a relationship between a size, a thickness, a basis weight, a grain direction, or surface smoothness of the sheet S and the acting position (drive pulses of the holder drive motor M2) corresponding to them.

In addition, if the amount of ink used for image formation increases, weight of the sheet S is increased, and hence the conveying power necessary for moving the sheet S is increased. Therefore, if the amount of ink is more than the reference output information, the acting position of the alignment paddle 57 is corrected to be closer to the processing tray 521 than the reference acting position. On the contrary, if the amount of ink is less than the reference output information, the acting position of the alignment paddle 57 is corrected to be more distant from the processing tray 521 than the reference acting position. The correction amount from the reference acting position is determined based on a correction table, which defines a relationship between the amount of ink and the acting position (drive pulses of the holder drive motor M2) corresponding to it.

If it is determined that it is not necessary to correct the acting position (No in Step S2), the post-processing control unit 10 proceeds to the next stop without changing the acting position of the alignment paddle 57 from the reference acting position.

Next, the post-processing control unit 10 starts to carry in the sheet S, which is carried into the sheet post-processing device 1 through the sheet carry-in entrance 2, onto the processing tray 521 (Step S4). Specifically, when the sheet detection sensor 93 detects that the rear end of the sheet S passes the carry-in roller pair 54, the post-processing control unit 10 (see FIG. 2) controls the tapping member 53 to tap the rear end of the sheet S to be along the processing tray 521, and then controls the holder drive motor M2 to move the paddle holder 56 downward by a predetermined amount. In this way, the alignment paddle 57 moves in the acting position, and the paddle part 572 makes contact with the top surface of the sheet S. In this state, the alignment paddle 57 is rotated, and hence the sheet S is pulled in along the processing tray 521 in the alignment direction (arrow B direction).

After that, the sheet S is further sent to the downstream side in the alignment direction by the alignment paddle 57, and is aligned by the width restricting member 523 (see FIG. 3) in the sheet width direction, and is aligned by the reference plate 73 in the carry-in direction, so as to be stacked.

The post-processing control unit 10 counts the number of sheets S carried in onto the processing tray 521 (Step S5). Further, every time when one sheet S (or a predetermined number of sheets S) is carried in, the stop position of the paddle holder 56 is moved upward, and the acting position of the alignment paddle 57 is continuously moved upward.

Next, the post-processing control unit 10 determines whether or not a predetermined number of sheets S have been carried in onto the processing tray 521 (Step S6). If a predetermined number of sheets S have not carried in (No in Step S6), the process returns to Step S4, and the carrying in of the sheets S onto the processing tray 521 and the counting of the number of the carried-in sheets are continued.

If a predetermined number of sheets S have been carried in (Yes in Step S6), the post-processing control unit 10 sends a control signal to the stapling unit drive motor M1 (see FIG. 3) so as to move the stapling unit 71 to a predetermined staple position. After the stapling unit 71 is moved to the predetermined staple position, the post-processing control unit 10 sends a control signal to the stapling unit 71, so as to perform the stapling process on the plurality of sheets S aligned by the reference plate 73 (Step S7).

Next, the post-processing control unit 10 controls the first discharge roller pair 42 to be the contact state (to form the nip), and controls the first discharge roller pair 42 to rotate in the discharge direction. In this way, the bundle of the sheets S after the stapling process is discharged by the first discharge roller pair 42 onto the first discharge tray 43, which are illustrated in FIG. 2 (Step S8). After the bundle of the sheets S are discharged, the post-processing control unit 10 sends a control signal to the stapling unit drive motor M1 so as to move the stapling unit 71 to a standby position (Step S9).

After that, the post-processing control unit 10 determines whether or not the stapling process is finished (Step S10). If the stapling process is continuing (No in Step S10), the process returns to Step S4, so as to repeat carrying in of the sheets S onto the processing tray 521, the counting of the number of the carried-in sheets, executing of the stapling process, discharge of the bundle of sheets, and the moving of the stapling unit 71 to the standby position (Steps S4 to S10). If the stapling process is finished (Yes in Step S10), the process is finished as it is.

According to the control example illustrated in FIG. 8, the acting position of the alignment paddle 57 is corrected to be an optimal position, on the basis of the output information of the sheet S. Therefore, without being affected by a type of the sheet S or amount of ink after image formation by the inkjet recording device, the sheet S can be securely conveyed and aligned.

In addition, as the acting position is continuously moved upward in accordance with the number of the sheets S carried in onto the processing tray 521, the contact state of the paddle part 57 with the top surface of the sheet S can be maintained to be constant regardless of the number of the carried-in sheets S.

Figure 9:
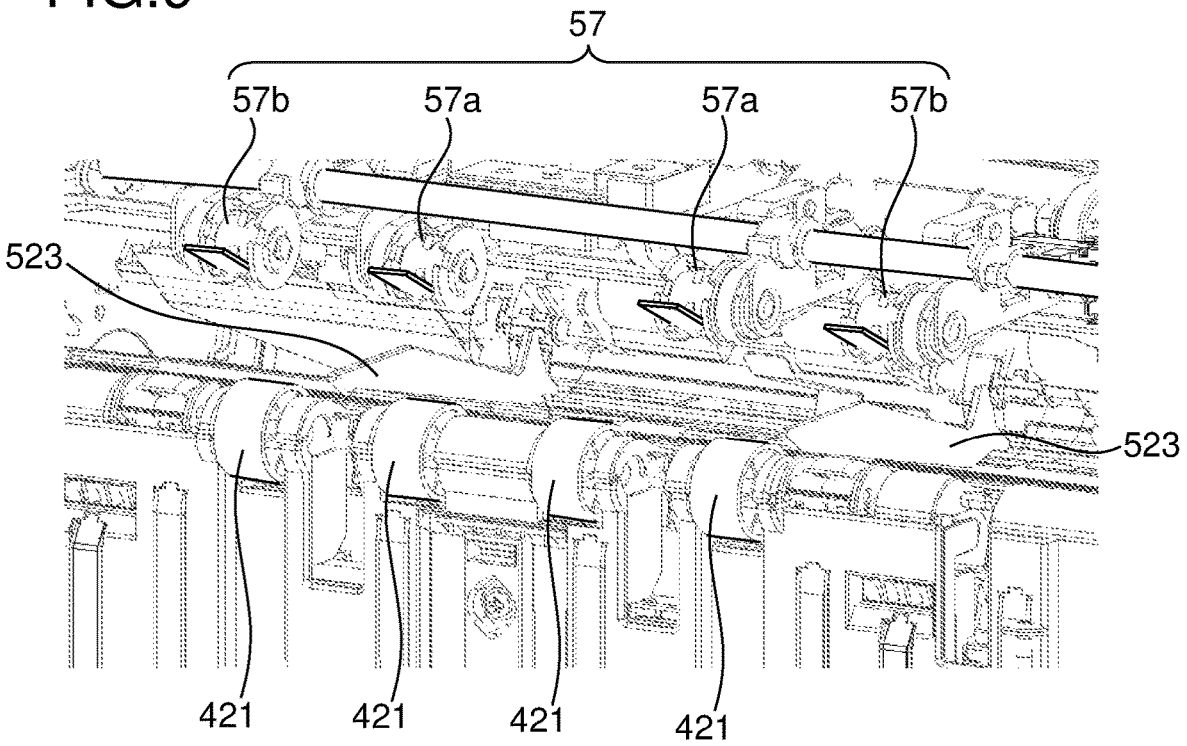
FIG. 9 is a perspective view of the alignment member and its vicinity in the sheet post-processing device of a second embodiment of the present disclosure, viewed from a downstream side in a discharge direction.

FIG. 9 is a perspective view of the alignment member 55 and its vicinity in the sheet post-processing device 1 of a second embodiment of the present disclosure, viewed from the downstream side in the discharge direction. In this embodiment, the alignment paddle 57 of the alignment member 55 includes a pair of first alignment paddles 57*a* disposed in the middle part in the sheet width direction, and a pair of second alignment paddles 57*b* disposed outside of the first alignment paddles 57*a* in the sheet width direction. The structures of the first alignment paddle 57*a* and the second alignment paddle 57*b* are the same as that of the alignment paddle 57 of the first embodiment illustrated in FIG. 6.

Figure 10:
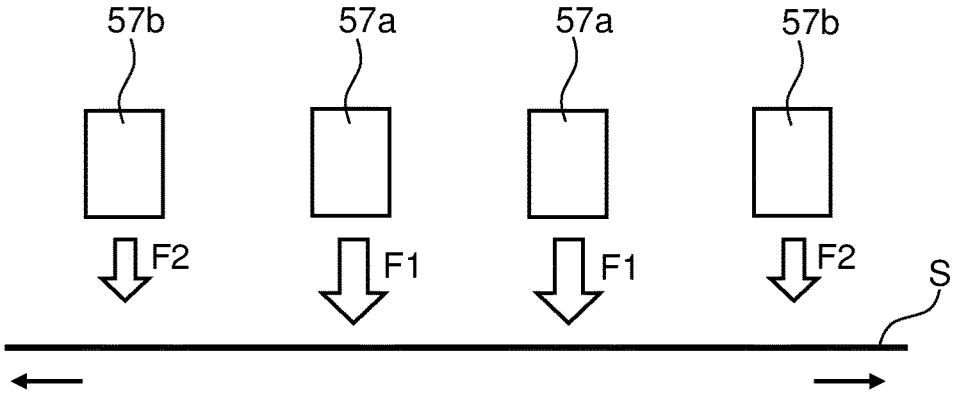
FIG. 10 is a schematic diagram illustrating a relationship between a sheet deflection state and pressing forces of a first alignment paddle and a second alignment paddle in the sheet post-processing device of the second embodiment.

FIG. 10 is a schematic diagram illustrating a relationship between a deflection state of the sheet S and pressing forces of the first alignment paddle 57*a* and the second alignment paddle 57*b* in the sheet post-processing device 1 of the second embodiment. The white arrows in FIG. 10 indicate magnitudes of pressing forces F1 and F2 of the first alignment paddle 57*a* and the second alignment paddle 57*b* applied to the sheet S. As illustrated in FIG. 10, the pressing force (first pressing force) F1 of the first alignment paddle 57*a* is set larger than the pressing force (second pressing force) F2 of the second alignment paddle 57*b*. In other words, the pulling force acting on the sheet S is larger on the inside than the outside in the width direction of the sheet S.

In this way, the pulling timing of the sheet S by the second alignment paddle 57*b* on the outside in the width direction is a little delayed from the pulling timing of the sheet S by the first alignment paddle 57*a* on the inside in the width direction. As a result, a force is applied to the sheet S in the direction to expand it outside in the width direction, and hence the sheet is pulled in onto the processing tray 521 without a deflection in the width direction.

Figure 11:
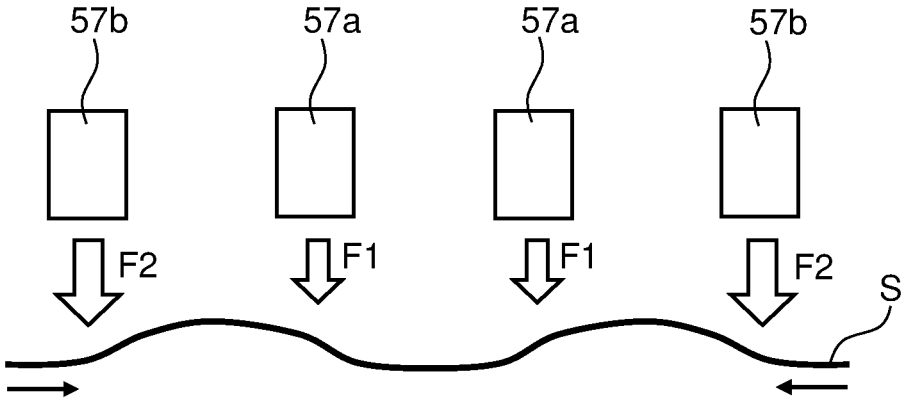
FIG. 11 is a schematic diagram illustrating the sheet deflection state when the pressing force of the first alignment paddle is set smaller than that of the second alignment paddle, as a comparative example.

FIG. 11 is a schematic diagram illustrating the deflection state of the sheet S when the pulling force of the first alignment paddle 57*a* is set smaller than that of the second alignment paddle 57*b*, as a comparative example. As illustrated in FIG. 11, if the pressing force F1 of the first alignment paddle 57*a* is set smaller than the pressing force F2 of the second alignment paddle 57*b*, the pulling force acting on the sheet S becomes larger on the outside than the inside of the sheet S in the width direction. As a result, the pulling timing of the sheet S on the outside in the width direction becomes earlier, and hence a force is applied to the sheet S in the direction to pull the sheet S to the inside in the width direction.

Therefore, the sheet S tends to be deflected in the width direction, so that a wrinkle may occur in the sheet S or resilience of the deflected sheet S may cause a rebound. Note that even if the pressing forces of the first alignment paddle 57*a* and the second alignment paddle 57*b* are set equal to each other, a variation of the pressing force may cause a deflection of the sheet S in the width direction.

As illustrated in FIG. 10, by setting the pressing force F1 of the first alignment paddle 57*a* larger than the pressing force F2 of the second alignment paddle 57*b* in advance, even if there is a variation in the pressing force, the deflection of the sheet in the width direction, and wrinkle or rebound of the sheet S due to the same can be suppressed. Further, alignment property of the sheet S pulled in onto the processing tray 521 can be improved.

The pressing forces of the first alignment paddle 57*a* and the second alignment paddle 57*b* can be adjusted by adjusting the acting positions of the first alignment paddle 57*a* and the second alignment paddle 57*b*. For instance, there is a method of setting the acting position of the first alignment paddle 57*a* closer to the processing tray 521 than the second alignment paddle 57*b*.

In addition, the pressing forces of the first alignment paddle 57*a* and the second alignment paddle 57*b* can be adjusted by adjusting materials or thicknesses of the paddle parts 572 constituting the first alignment paddle 57*a* and the second alignment paddle 57*b*. For instance, there is a method of making the paddle part 572 of the first alignment paddle 57*a* using a material having a larger Young's modulus (longitudinal elastic modulus) than the material of the paddle part 572 of the second alignment paddle 57*b*. In addition, if the paddle parts 572 of the first alignment paddle 57*a* and the second alignment paddle 57*b* are made of the same material, there is a method of setting the thickness of the paddle part 572 of the first alignment paddle 57*a* larger than that of the paddle part 572 of the second alignment paddle 57*a*.

Note that two first alignment paddles 57*a* are disposed here, but it may be possible to dispose one first alignment paddle 57*a* in the middle part in the sheet width direction. In addition, although one pair of the second alignment paddles 57*b* is disposed outside the first alignment paddles 57*a*, it may be possible to dispose two or more pairs of the second alignment paddles 57*b*.

Although the embodiments of the present disclosure are described above, the scope of the present disclosure is not limited to these, but can be variously modified for implementation within the scope of the invention without deviating from the spirit thereof. For instance, in the first embodiment described above, the post-processing control unit 10 automatically adjusts the acting position of the alignment paddle 57 based on the output information of the sheet S, but it may be possible that the user can adjust the acting position of the alignment paddle 57 at any timing. For instance, there is a structure in which a conveying power adjusting mode is provided to the operation panel 202, in which the conveying power of the alignment paddle 57 is switched in three steps of "small", "middle", and "large", so that the user can select the mode in accordance with a situation of the stapling process (alignment property) in the sheet stapling unit 92.

In addition, in the embodiment described above, the case where the sheet stapling unit 92 performs the stapling process on the sheets S stacked on the processing tray 521 is exemplified, but the present disclosure is not limited to this, and may have a structure in which a shift discharge process or the folding process is performed on the sheets S stacked on the processing tray 521.

In addition, in the first embodiment described above, information about a type of the sheet S among the output information of the sheet S is input from the operation panel 202 of the image forming apparatus 200, but it may be possible that the output information of the sheet S is automatically obtained. For instance, a media sensor is disposed at any position in the sheet conveying path from the image forming apparatus 200 to the sheet post-processing device 1, and the output information of the sheet S such as a size, a thickness, a basis weight, a grain direction, surface smoothness, or amount of ink of the sheet S carried into the sheet post-processing device 1 from the image forming apparatus 200 can be detected using the media sensor.

For instance, in order to detect the thickness of the sheet S, a laser coaxial displacement meter can be used as the media sensor, which detects the thickness by sandwiching the sheet S using two optical sensors.

In order to detect the basis weight of the sheet S, a basis weight sensor can be used as the media sensor, which measures the basis weight based on transmittance of light through the sheet S. Note that depending of type of the sheet S, the relationship between the light transmittance and the basis weight varies, and hence it is necessary to select an optimal basis weight conversion formula for each type of the sheet S. In addition, by dividing the basis weight ($g/m^2$) by the thickness (m), it is possible to calculate density ($g/m^3$) of the sheet S.

In order to detect the grain direction of the sheet S, an image sensing device is used as the media sensor, for example, and a transmission image is captured when LED light is emitted to the backside of the conveyed sheet S, and the captured transmission image is compared with a datum image stored in the main body control unit 203 in advance, so as to detect the grain direction of the sheet S. Alternatively, an ultrasonic measuring device is used as the media sensor, and a reflection waveform when an ultrasonic wave is emitted to the sheet S is measured and compared with a reference waveform stored in the main body control unit 203 in advance, so that the grain direction of the sheet S can be detected.

In order to detect the surface smoothness of the sheet S, it is possible to use a surface property sensor that discriminates surface characteristics of the sheet S using optical reflection characteristics. In general, a sheet S such as plain paper or matte paper having low smoothness (rough surface) has reflection characteristics of perfect diffusion. In contrast, a sheet S such as glossy paper having high smoothness (high glossiness) has a state in which positive reflection and diffusion are mixed. The surface property sensor detects the surface property of the sheet S using the difference of the reflection characteristics described above.

In order to detect type of the sheet S, a paper type discrimination algorithm is used, in which the type of the sheet S is discriminated using density, surface property (positive reflection light, diffusion light), basis weight, and the like of the sheet S.

In addition, the amount of ink on the sheet S can be detected using a moisture meter as the media sensor, which detects water content in the sheet S.

In addition, in the embodiment described above, the inkjet recording device is exemplified as the image forming apparatus 200, but an electrophotographic printer or copier can also be used as the image forming apparatus 200. Note that in the inkjet recording method in which ink is ejected to the sheet S, the conveying load of the sheet S tends to vary more than in the electrophotographic method. Therefore, the present disclosure is particularly useful for the sheet post-processing device 1 connected to the inkjet recording device as the image forming apparatus 200.

The present disclosure can be used for a sheet post-processing device that performs predetermined post-processing on a plurality of sheets.

What is claimed is:

1. A sheet post-processing device comprising:

a conveying member configured to convey a sheet;

a processing tray configured to stack a plurality of the sheets carried in by the conveying member in a predetermined carry-in direction;

a processing section configured to perform predetermined post-processing on the sheets placed on the processing tray;

a reference plate configured to abut an end edge of the sheet carried in onto the processing tray, on a downstream side in an alignment direction opposite to the carry-in direction, so as to align the sheet in the carry-in direction;

an alignment member including a paddle holder disposed above the processing tray so as to be supported in a swingable manner in the carry-in direction, and an alignment paddle having a paddle main body supported in a rotatable manner at a swinging end of the paddle holder and one or more paddle parts protruding from the paddle main body in a radial direction, so as to move the sheet carried in onto the processing tray in the alignment direction for aiding alignment of the sheets;

a holder drive unit configured to swing the paddle holder, so as to move the alignment paddle in a reciprocating manner between a reference position to retreat the paddle part above a top sheet placed on the processing tray and an acting position to allow the paddle part to contact with the top surface of the sheet; and a control unit configured to control the holder drive unit, wherein when the number of the sheets carried in onto the processing tray is increasing, the control unit continuously moves the acting position of the alignment paddle in a direction separating from the processing tray, the alignment paddle includes one or more first alignment paddles disposed in a middle part in the sheet width direction, and one or more pairs of second alignment paddles disposed outside the first alignment paddles in the sheet width direction, the first alignment paddle moves the sheet in the alignment direction while pressing a top surface of the sheet by a first pressing force, the second alignment paddle moves the sheet in the alignment direction while pressing the top surface of the sheet by a second pressing force, and the first pressing force is larger than the second pressing force.

2. The sheet post-processing device according to claim 1, wherein the control unit corrects the acting position of the alignment paddle based on output information about characteristics of the sheet.

3. The sheet post-processing device according to claim 2, wherein the output information about characteristics of the sheet includes at least one of a size, a thickness, a basis weight, a grain direction, and surface smoothness of the sheet.

4. The sheet post-processing device according to claim 1, wherein the processing section is a stapling unit that performs a stapling process to staple the plurality of sheets placed on the processing tray at a predetermined position with a staple needle.

5. The sheet post-processing device according to claim 1, wherein the acting position of the first alignment paddle is closer to the processing tray than the acting position of the second alignment paddle.

6. The sheet post-processing device according to claim 1, wherein the paddle part of the first alignment paddle is made of a material having a larger Young's modulus than the paddle part of the second alignment paddle.

7. The sheet post-processing device according to claim 1, wherein the paddle part of the first alignment paddle is made of the same material as the paddle part of the second alignment paddle, and has a larger thickness than the paddle part of the second alignment paddle.

8. An image forming system comprising:

an image forming apparatus configured to form an image on a sheet; and the sheet post-processing device according to claim 1, configured to perform predetermined post-processing on the sheet after image formation by the image forming apparatus.

9. An image forming system comprising:

an image forming apparatus configured to form an image on a sheet; and the sheet post-processing device according to claim 1, configured to perform predetermined post-processing on the sheet after image formation by the image forming apparatus, wherein the image forming system further comprises an input section for inputting output information about characteristics of the sheet.

10. The image forming system according to claim 9, wherein the acting position of the alignment paddle is correctable at any timing by an input operation to the input section.

11. An image forming system comprising:

an image forming apparatus configured to form an image on a sheet; and the sheet post-processing device according to claim 2, configured to perform predetermined post-processing on the sheet after image formation by the image forming apparatus, wherein the image forming apparatus is an inkjet recording device configured to perform image formation by ejecting ink onto the sheet, and the output information about characteristics of the sheet includes amount of ink used for image formation on the sheet.

* * * * *